US006679439B2

(12) United States Patent
Duqueroie

(10) Patent No.: US 6,679,439 B2
(45) Date of Patent: Jan. 20, 2004

(54) DEVICE FOR DISPENSING A FLUID PRODUCT AND METHOD OF DISPENSING A FLUID PRODUCT

(75) Inventor: Florent Duqueroie, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/177,141

(22) Filed: Jun. 24, 2002

(65) Prior Publication Data

US 2003/0010844 A1 Jan. 16, 2003

(30) Foreign Application Priority Data

Jun. 22, 2001 (FR) ..... 01 08278

(51) Int. Cl.[7] ..... B65D 1/32

(52) U.S. Cl. ..... 239/327; 239/328; 239/329; 239/323; 222/92

(58) Field of Search ..... 239/327, 323, 239/328, 329; 222/92, 95, 107, 631, 632, 494

(56) References Cited

U.S. PATENT DOCUMENTS

| | | | | |
|---|---|---|---|---|
| 3,412,907 A | * | 11/1968 | Faso | 222/187 |
| 3,583,602 A | | 6/1971 | Gruber et al. | |
| 3,897,005 A | | 7/1975 | Reiner | |
| 4,275,840 A | * | 6/1981 | Staar | 239/327 |
| 4,787,536 A | * | 11/1988 | Widerstrom | 222/212 |
| 5,129,550 A | | 7/1992 | Eschbach | |
| 5,139,168 A | * | 8/1992 | Gueret | 222/92 |
| 5,178,300 A | * | 1/1993 | Haviv et al. | 222/95 |
| 5,215,221 A | * | 6/1993 | Dirksing | 222/94 |
| 6,460,781 B1 | * | 10/2002 | Garcia et al. | 239/327 |

FOREIGN PATENT DOCUMENTS

| | | | |
|---|---|---|---|
| BE | 870 592 | 1/1979 | |
| EP | 0 761 314 | 3/1997 | |
| FR | 2 443 980 | 7/1980 | |
| FR | 2 778 639 | 11/1999 | |
| WO | WO 99/59881 | * 11/1999 | B65D/1/32 |
| WO | WO 01/81184 | 11/2001 | |

OTHER PUBLICATIONS

Co–pending Application—Attorney Docket No. 05725–1075–00000 Title: Device for Dispensing a Fluid product and Method of Dispensing a Fluid Product Inventor: Florent Duqueroie U.S. Filing Date: Jun. 24, 2002.

English language Derwent Abstract of BE 870 592, Jan. 15, 1979.

English language Derwent Abstract of EP 0 761 314, Mar. 12, 1997.

English language Derwent Abstract of FR 2 778 639, Nov. 19, 1999.

* cited by examiner

*Primary Examiner*—Gregory L. Huson
*Assistant Examiner*—Amanda Flynn
(74) *Attorney, Agent, or Firm*—Finnegan, Henderson, Farabow, Garrett & Dunner, LLP

(57) ABSTRACT

A device for dispensing a fluid product includes a reservoir configured to contain a fluid product and a spray orifice associated with the reservoir. The reservoir may include at least one actuating wall having a predetermined threshold resistance to deformation. The actuating wall may be configured to deform in response to pressure exerted on the actuating wall so as to cause the product to be sprayed out from the orifice. When pressure exerted on the actuating wall is less than a threshold pressure $P_s$ sufficient to overcome the predetermined threshold resistance to deformation of the actuating wall, substantially no portion of the product is sprayed from the spray orifice. At least upon a first use of the device, continuous exerting of the threshold pressure $P_s$ on the actuating wall causes spraying of the product from the spray orifice for a spray duration that is capable of being altered.

38 Claims, 2 Drawing Sheets

DEVICE FOR DISPENSING A FLUID PRODUCT AND METHOD OF DISPENSING A FLUID PRODUCT

BACKGROUND OF THE INVENTION

1. Field of the Invention

The present invention relates to a device for dispensing a product, for example, a fluid product, in the form of a spray. In one example, the device could be configured to dispense a miniature spray of one or more cosmetic products and/or care products, for example, a product comprising at least one substance for imparting a scent.

2. Description of the Related Art

Examples of some dispensers are generally described in the following patent applications: FR-A-2 778 639, EP-A-0 761 314, FR-A-2 443 980; and in U.S. Pat. Nos. 3,897,005, and 3,412,907. These devices generally suffer from at least one principal drawback, such as, for example, cost of manufacture, difficulty to use, or inability to generate a quality spray.

For example, for dispensers that contain samples of products that are generally not intended for sale, it is sometimes desired to keep the cost of manufacture as low as possible. In such dispensers, it may be important for the devices to include parts which can be produced easily by mass production and which can be assembled in a simple manner. Furthermore, it is sometimes desired for dispensers to be capable of generating a spray possessing good quality and consistent characteristics. It may also be desirable for dispensers to generate a relatively gentle spray for a certain duration, so that the spray may possess characteristics similar to the spray of an aerosol-type spray.

One solution for producing dispensers at a lower cost might include producing a reservoir in the form of a dosing bottle, for example, a dosing bottle of the type sometimes used for dispensing some physiological serums, eye ointments, and/or makeup removing products. Such a dosing bottle may be formed in a single piece, for example, with a spray orifice which may be opened by pulling off an endpiece (e.g., by twisting the endpiece off about the axis of the spray orifice). Such a dispenser may be filled via an open bottom in the reservoir. The open bottom may then be sealed, for example, by welding, in a manner similar to welding the end of a tube.

Such a solution may, however, suffer from two major drawbacks. A first drawback may arise from the fact that upon opening, the spray orifice resulting from pulling-off the endpiece (e.g., by twisting) may have an imprecise shape and size. This may result in the spray characteristic varying greatly from one device to another when compressible walls of the reservoir are pressed to initiate spraying. In some instances, the cross-section of the orifice may be such that it is not possible to generate a spray. In such instances, the product may be able to flow out of the dispensing orifice only in the form of droplets of a greater or lesser size, or in the form of a continuous stream, rather than in the form of a spray.

A second drawback may be found, for example, in the welding operation. For example, in a dispenser containing a highly volatile product such as a scent, there is a risk that the product will evaporate when subjected to the heat associated with a welding process. The product may even deteriorate or ignite.

In addition, in some known devices, the quality of the spray may depend on the rate at which the compressible walls of the reservoir are pressed. In such devices, if the walls are pressed slowly, the spray may be of poor quality. FR 2 778 639 describes a spray device including a wall having a predetermined threshold of resistance to deformation that makes it possible to obtain a good quality spray. Nevertheless, in this particular device, there is no provision for producing a spray duration which is capable of being altered.

One subject of the invention relates to a dispenser, for example, a spray device, which may fully or partly obviate one or more drawbacks associated with the related art. Another subject of the invention relates a device which may be easy to mass-produce in a cost-effective manner. Another subject of the invention concerns a device for dispensing which may render it possible to generate a spray of satisfactory quality which may be consistently reproducible from one device to another. A further subject of the invention pertains to a device that may be capable of generating spray for a certain duration, and that may be capable of obtaining a relatively gentle spray. These subjects are optional and exemplary. Other subjects might also be possible.

SUMMARY OF THE INVENTION

In the following description, certain aspects and embodiments will become evident. It should be understood that the invention, in its broadest sense, could be practiced without having one or more feature of these aspects and embodiments. It should also be understood that these aspects and embodiments are merely exemplary.

In one aspect, as embodied and broadly described herein, the invention includes a device for dispensing a fluid product. The device includes a reservoir configured to contain a fluid product. The reservoir may include at least one actuating wall having a predetermined threshold resistance to deformation, and a spray orifice associated with the reservoir. The actuating wall may be configured to deform in response to pressure exerted on the actuating wall so as to cause the product to be sprayed out from the orifice. Moreover, the actuating wall may be configured so that when pressure exerted on the actuating wall is less than a threshold pressure $P_s$ sufficient to overcome the predetermined threshold resistance to deformation of the actuating wall, substantially no portion of the product is sprayed from the spray orifice. The device may be configured so that, at least upon a first use of the device, continuous exerting of the threshold pressure $P_s$ on the actuating wall causes spraying of the product from the spray orifice for a spray duration that is capable of being altered. For example, the device may be configured so that exerting of at least the threshold pressure $P_s$ on the actuating wall may cause the actuating wall to deform suddenly, thereby creating an overpressure condition within the reservoir.

As used herein, a wall having a "threshold resistance to deformation" means a wall configured in such a way that its deformation does not depend linearly on the pressure exerted on it in order to deform it, but entails the passing of a threshold. Thus, pressure exerted by a user on the actuating wall before the threshold pressure $P_s$ (i.e., the pressure necessary and sufficient to overcome the predetermined threshold resistance to deformation of the actuating wall) is reached, may cause some deformation of the wall which does not allow the product to be sprayed but which does allow energy to be built up so that when the pressure exerted by the user on the wall reaches the threshold pressure $P_s$, the wall deforms suddenly. The volume inside the reservoir is then reduced in such a way that an overpressure is suddenly created inside the reservoir. This overpressure allows the product to be expelled from the spray orifice in the form of a spray. In at least some embodiments, that spray may be a good quality spray.

As used herein, the term "spray" means to eject and/or disperse a substance (e.g., a liquid) in the form of a mass or cloud of droplets, or in a discontinuous stream of droplets, such as, for example, in an atomizing fashion where the substance is in the form of a fine mist of tiny particles and/or droplets. In one example, the "spray" could be in a form similar to that of perfume dispensed in small particles dispersed in the air. In another example, the "spray" could be in a form similar to that sometimes associated with aerosol dispensers.

The range of times for which the duration of spraying is to be altered may determine certain aspects of the configuration of the device, for example, the cross-section of the spray orifice and its maximum throughput (e.g., its throughput as a function of the viscosity of the product and of the overpressure that may be generated inside the reservoir in response to the pressure exerted on the actuating wall). In determining these parameters, the nature of the materials, the thickness of the actuating wall, the profile of the actuating wall and/or the reservoir, and/or the volume of the reservoir, among other parameters, for example, may be altered.

In another aspect, the device may be configured so that the spray duration is altered according to the time during which pressure is exerted on the actuating wall. The range for which the time can be altered is not infinite. For example, after a certain length of time of continuous exertion of the pressure $P_s$, if no additional energy is applied, the overpressure inside the reservoir will drop below the value required for causing spraying. Spraying may then be interrupted. By releasing the pressure exerted on the actuating wall, and then by exerting pressure again, one may be able to alter the spray duration. The device may be operated in this manner until the volume of product in the reservoir becomes insufficient to obtain the slightest amount of spraying in response to the pressure $P_s$. In such cases, and in order to achieve maximum emptying of the reservoir, it may be necessary to exert a pressure higher than the pressure $P_s$.

In another aspect, the device may be configured to provide an atomizing spray of the product from the spray orifice.

In yet another aspect, the device of may be configured to contain a sample dose of fluid product, and the device may further include the fluid product contained in the reservoir. For example, at least prior to a first use of the device, the product may have a volume ranging from about 0.5 milliliter to about 15 milliliters. The product may include at least one of a cosmetic product and a care product and such a product may have a volume that is a sample dose. For example, the product may include at least one component imparting a scent to the product. In some examples, the product may comprise at least one of a perfume and a cologne.

In another aspect, the device may be configured to alter the spray duration over a range of from about 1 second to about 45 seconds. For example, the device may be configured to alter the spray duration over a range of from about 2 seconds to about 10 seconds.

According to yet another aspect, the actuating wall may be configured to revert to its initial shape via elastic return (e.g., have shape memory) when the pressure exerted on the actuating wall ceases. This may enable the device to be used several times in succession. For example, the actuating wall may be configured to be deformed from an undeformed position to a deformed position, and may be provided with a substantially convex profile (e.g., in the form of a dome) in its undeformed position and a substantially concave profile in its deformed position. The deformed position may occur when the pressure exerted on the actuating wall reaches the threshold pressure $P_s$. Such a configuration may render it possible to more easily obtain a wall with a threshold resistance to deformation which substantially corresponds to the change between the concave profile and the convex profile. This configuration may also encourage the actuating wall to return to the convex position when the pressure ceases.

In still another aspect, the actuating wall of the reservoir may be formed of thermoplastic material. For example, the thermoplastic material may be selected from polyethylenes, polypropylenes, polyethylene terephthalates, polyethylene naphthalates, polyacrylonitriles, polyoxymethylenes, and polyvinyl chlorides.

In a further aspect, the device may be provided with a diffuser including, for example, a nozzle and the spray orifice. The nozzle may include at least one swirl-inducing duct. For example, a portion of the device defining the spray orifice may be configured to induce a swirl to product sprayed from the spray orifice. A swirl-inducing duct may render it possible to accelerate the fluid upstream of the spray orifice so as to produce very fine particles of liquid. The spray orifice could also be alternatively formed as a relatively simple nozzle. In addition, the diffuser may be mounted, for example, on the reservoir via one of snap-fastening and screw-fastening. Thus, when the reservoir is empty, such a diffuser may be removed so as to refill the reservoir in order to reuse the device. Alternatively, an intermediate element may be provided between the reservoir and the diffuser. The intermediate element may be, for example, an endpiece which may be mounted on the reservoir (e.g., by snap-fastening and/or screw-fastening). The diffuser may be mounted on the endpiece, for example, by bonding and/or welding (e.g., by applying heat).

In an additional aspect, the reservoir may define an interior volume in an undeformed state ranging from about 0.2 milliliter to about 15 milliliters. According to another aspect, the reservoir may define an interior volume in an undeformed state ranging from about 0.5 milliliter to about 10 milliliters. The reservoir may define an interior volume in a deformed state ranging from about 0.17 milliliter to about 14 milliliters, for example, from about 0.4 milliliter to about 9 milliliters. For example, the difference between an interior volume of the reservoir in an undeformed state and a deformed state may range from about 0.01 milliliter to about 2.25 milliliters, for example, from about 5% to about 15% of the interior volume of the reservoir in the undeformed state.

In still a further aspect, a portion of the reservoir opposite the actuating wall may define a substantially planar surface. In addition, the device may define a substantially tear-drop shape. At least a portion of the reservoir may be one of at least partially transparent and at least partially translucent, and/or the reservoir may include at least one substance imparting a color to the reservoir.

According to another aspect, the reservoir may include a first portion comprising the actuating wall and at least one other portion. In one embodiment of a device having such a configuration, when the threshold pressure $P_s$ is exerted on the first portion and the other portion, substantially only the actuating wall may deflect.

In an additional aspect, a method of dispensing a product may include providing the device for dispensing, and exerting the threshold pressure $P_s$ on the actuating wall so as to spray the product from the spray orifice. The product may include at least one of a cosmetic product and a care product. In another aspect, the method may also include directing spray of the product toward a body region (e.g., the skin, an article of clothing on the skin, and/or hair). The product may include at least one component imparting a scent to the product. For example, the product may include at least one of a perfume and a cologne. According to an additional aspect, the spraying of the product may occur for a predetermined duration of time. In still another aspect, the spraying may occur until the pressure exerted on the actuating wall drops below the threshold pressure $P_s$. The volume of the product sprayed may range from about 0.01 milliliter to about 1 milliliter.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings.

DESCRIPTION OF EMBODIMENTS

Figure 1:
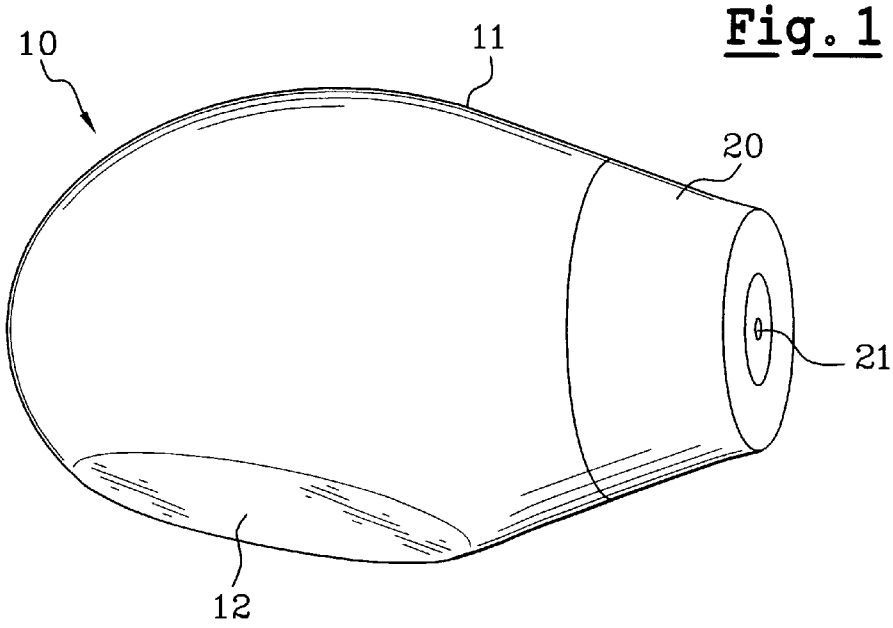
FIG. 1 is a perspective view of an embodiment of a device for dispensing a fluid product.

Reference will now be made in detail to some possible embodiments of the invention, examples of which are illustrated in the accompanying drawings. Wherever possible, the same reference numbers are used in the drawings and the description to refer to the same or like parts.

Figure 2:
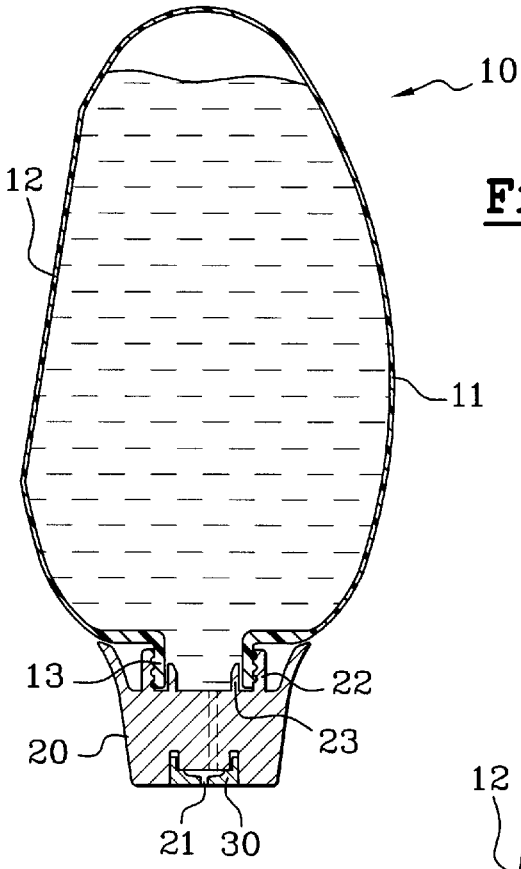
FIG. 2 is a schematic cross-section view of the device FIG. 1.
Figure 3:
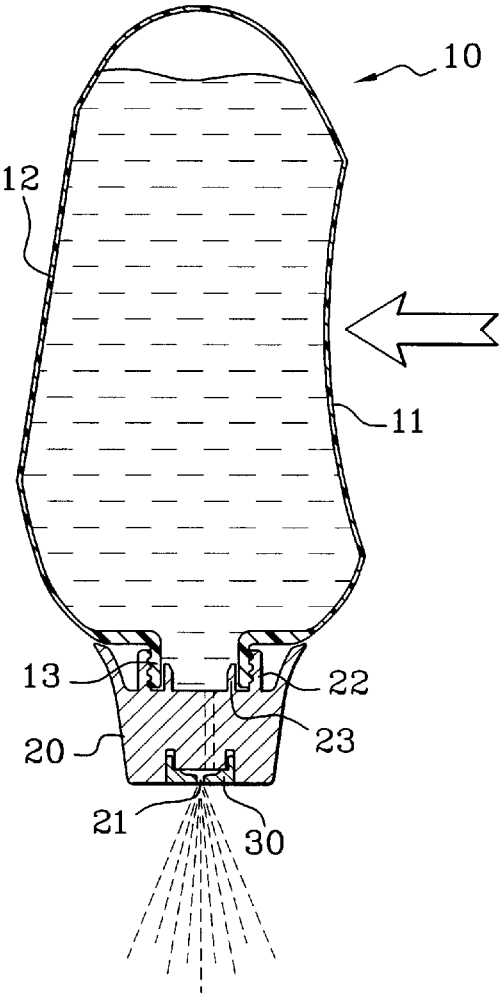
FIG. 3 is a schematic cross-section view of the device of FIG. 1 when subjected to a pressure.

The device depicted in FIGS. 1–3 includes a reservoir 10 (e.g., a deformable-walled reservoir) for containing the product to be dispensed. Mounted on the reservoir 10, there may be a diffuser 20, which may include, for example, a spray orifice 21 in communication with the inside of the reservoir 10. In such an exemplary embodiment, by exerting pressure on the wall of the reservoir 10, an overpressure may be created inside the reservoir 10 which may cause the product to be sprayed from the spray orifice 21.

According to the embodiment depicted in FIGS. 1–3, the reservoir 10 may be configured in the form of a tear-drop, although the reservoir 10 may have any other shape allowing at least a portion of one of its at least one walls to be deformed. The reservoir may be formed, for example, by molding, such as by injection blow-molding. For example, the reservoir 10 may be formed as a single piece of a thermoplastic material (e.g., the reservoir may be formed of at least one of polyethylenes, polypropylenes, polyethylene terephthalates, polyethylene naphthalates, polyacrylonitriles, polyoxymethylenes, and polyvinyl chlorides).

The reservoir 10 may be provided with an actuating wall 11, for example, having a domed shape, which may be deformed when pressure is applied thereto. The actuating wall 11 may have shape memory so that the wall 11 may be able to revert to an initial position when the pressure exerted ceases. In another portion of the reservoir 10 (e.g., opposite the actuating wall 11), the reservoir 10 may have a wall 12 that is substantially flat, although walls having other configurations are possible and are contemplated. Such a configuration of the reservoir 10 may render it easier to identify a zone on which the user may apply pressure so that the operation of the device may be more readily apparent. This exemplary configuration may also allow a user of the device to easily grasp the device, for example, between two fingers, with a user placing the thumb on the wall 12 and the index finger on the actuating wall 11, or vice versa. A user may thus exert pressure on the actuating wall 11 using his/her index finger or thumb, for example, thereby possibly spraying the product more easily.

The reservoir 10 may be provided with an open neck 13, for example, a neck having a threaded external surface. A diffuser 20 may be threaded onto the neck 13 of the reservoir 10, with the neck 13, for example, being arranged as a continuation of the wall of the reservoir 10 so as to form the end of device (e.g., when the device forms a tear-drop shape). The diffuser 20 may be fitted with a fixing skirt 22, which may be threaded on its interior surface in order to engage with the neck 13 of the reservoir 10. A cylindrical sealing skirt 23 may be configured to become lodged inside the neck 13 of the reservoir 10, and thus may afford sealing between the opening of the neck 13 and the diffuser 20. The diffuser 20 may be formed by molding (e.g., molding as a single piece) of a thermoplastic material. For example, the diffuser 20 may be formed by molding at least one of polyethylenes and polypropylenes.

A nozzle 30 (e.g., a nozzle having at least one swirl-inducing duct) may be mounted on the diffuser 20. The spray orifice 21 may be formed in the nozzle 30 and may be in communication with the interior of the reservoir 10, for example, via the interior of the neck 13. The nozzle 30 may be mounted on the diffuser 20 by any appropriate means. For example, the nozzle 30 may be mounted by at least one of bonding, welding, clamping, and snap-fastening.

Figure 4:
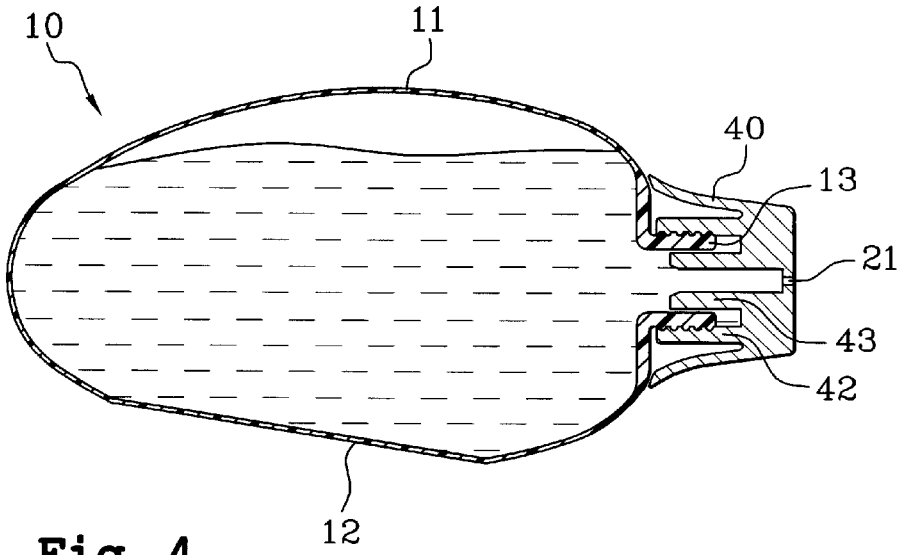
FIG. 4 is a schematic cross-section view of another embodiment of a device for dispensing a product.

According to another embodiment, as shown in FIG. 4, a device (e.g., a spray device) may include, for example, a simple endpiece 40 equipped with a spray orifice 21 instead of a diffuser 20 equipped with the nozzle 30 as has been described previously herein. For example, the endpiece 40 may comprise a fixing skirt 42 threaded on an exterior surface so as to be threaded onto the neck 13 of the reservoir 10. The endpiece 40 may also comprise a sealing skirt 43 configured to be lodged inside the neck 13 of the reservoir 10.

In the embodiments shown in FIGS. 1–4, the reservoir 10 may be configured in such a way as to generate a good quality spray. For example, the actuating wall 11 may be provided with a predetermined threshold resistance to deformation below which the actuating wall 11 may deform slightly, and beyond which, the actuating wall 11 may deform suddenly, exhibiting, for example, a concave profile, as shown in FIG. 3. This predetermined threshold resistance to deformation may be determined, for example, according to the geometry of the actuating wall 11, according to the characteristics of the material used to form the actuating wall 11, and/or according to the thickness of the actuating wall 11. For example, the reservoir 10 may change from a first convex position (e.g., a position corresponding to an undeformed position), to a second concave position (e.g., corresponding to a deformed position). This second position may be predetermined, for example, according to the geometry of the actuating wall 11. The geometry of the actuating wall 11 may be such that the pressure to be exerted and/or the pressure needed to maintain a deformed position, may be below the threshold pressure $P_s$ needed to overcome the threshold of resistance to deformation. In such cases, the user may not tend to exert a greater pressure on the actuating wall 11 after it has reached its deformed position (e.g., its deformed concave position). This may result in the second predetermined position being substantially the same each time the threshold pressure $P_s$ is exerted on the actuating wall 11. As a result, for a given reservoir 10, it may be easy to determine the deformable volume (i.e., the difference in volume between the undeformed position and the predetermined deformed position). Furthermore, the remainder of the reservoir 10 may remain substantially undeformed, which means that, for example, when the actuating wall 11 is deformed, the interior volume of the reservoir 10 decreases. An overpressure is thus created within the reservoir 10 and may cause the product to be expelled through the nozzle 30. The overpressure may be created suddenly when the predetermined threshold to deformation is overcome, and the product may suddenly flow out of the reservoir 10 through the spray orifice 21.

When the actuating wall 11 reverts to its initial shape, for example, air may enter the reservoir 10 via the spray orifice 21 and/or another passage capable of allowing air to enter the reservoir 10. If any product remains inside the reservoir 10, an overpressure may be created once again by deforming the actuating wall 11 and thus another dose of product may be sprayed.

In order to obtain a significant maximum spraying time for continuous exertion of pressure on the actuating wall 11 allowing the user to alter the spraying time, the mean throughput of the nozzle 30 may be chosen, for example, according to the configuration of the reservoir 10 and/or according to the viscosity of the product that is to be sprayed.

For a given reservoir 10, the total volume of product that can be expelled from the reservoir 10 in the deformed position of the actuating wall 11 may be determined because the volume depends on the viscosity of the product and on the maximum overpressure to which it is subjected in the deformed position. For example, the more viscous the product, the higher the overpressure needed to spray it. Furthermore, the overpressure inside the container may be at a maximum at the start of use of the device 10 (e.g., when the reservoir 10 contains little air). After several uses, for example, the reservoir 10 may contain increasing amounts of air, which may be compressed as the volume of the reservoir 10 decreases. The overpressure generated by the change of the actuating wall 11 to the deformed position may therefore be reduced. The maximum overpressure may be determined as a function of the deformable volume of the reservoir 10, which may be determined, for example, as previously explained herein. For example, if it is desirable for a maximum volume to be able to be sprayed for N seconds, then a nozzle 30 having a mean throughput less than or equal to the ratio between the maximum volume of product and N may be selected. During these N seconds, if the user releases the pressure exerted on the actuating wall 11 in order to maintain the deformed state (e.g., the concave position), the reservoir 10 reverts to its initial volume and air enters the reservoir 10 through the spray orifice 21. The product may then no longer be subjected to an overpressure and spraying stops.

According to one exemplary embodiment, a reservoir 10 may be formed of, for example, polyethylene terephthalate (PET). The reservoir 10 may include an actuating wall 11, which, in an undeformed position, may have a convex profile that becomes concave in a deformed position. The actuating wall 11 in the undeformed position may be substantially a portion of a sphere that has a radius of curvature, for example, of about 50 millimeters. The actuating wall 11 may have a thickness of about 0.3 millimeters. In an undeformed state, the reservoir 10 may have a volume, for example, of about 7.5 milliliters, while having a deformable volume, for example, of about 0.5 milliliter. In such a case, when the actuating wall 11 is in the concave position, the volume of the reservoir 10 is about 7.0 milliliters. If the device is desired to spray (e.g., spray water) for about 5 seconds, for example, then a nozzle may be chosen that has a mean throughput of about 0.1 milliliter. The user may thus spray the product, for example, by exerting continuous pressure on the actuating wall 11, for about 5 seconds. However, the user could also spray the product for a shorter time, for example, for two, three, or four seconds, by releasing the pressure.

The device according to some exemplary embodiments of the invention may be used to dispense any cosmetic or care products, such as make-up, perfume, cologne, dermatological substance, or pharmaceutical compositions used for treating and/or changing the appearance and/or scent of hair or skin. However, in its broadest aspects, the present invention could be used to dispense many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for dispensing a fluid product, the device comprising:

a reservoir configured to contain a fluid product, the reservoir comprising at least one actuating wall having a predetermined threshold resistance to deformation; and a spray orifice associated with the reservoir, wherein the actuating wall is configured to deform in response to pressure exerted on the actuating wall so as to cause the product to be sprayed out from the orifice, wherein the actuating wall is configured so that when pressure exerted on the actuating wall is less than a threshold pressure $P_s$ sufficient to overcome the predetermined threshold resistance to deformation of the actuating wall, substantially no portion of the product is sprayed from the spray orifice, and wherein the device is configured so that, at least upon a first use of the device, continuous exerting of the threshold pressure $P_s$ on the actuating wall causes spraying of the product from the spray orifice for a spray duration that is capable of being altered.

2. The device of claim 1, wherein the device is configured so that the spray duration is altered according to the time during which pressure is exerted on the actuating wall.

3. The device of claim 1, wherein the device is configured to contain a sample dose of at least one of a cosmetic product and a care product.

4. The device of claim 1, wherein the device is configured to alter the spray duration over a range of from about 1 second to about 45 seconds.

5. The device of claim 1, wherein the device is configured to alter the spray duration over a range of from about 2 seconds to about 10 seconds.

6. The device of claim 1, wherein the actuating wall is configured to revert to its initial shape via elastic return when the pressure exerted on the actuating wall ceases.

7. The device of claim 6, wherein the actuating wall is configured to be deformed from an undeformed position to a deformed position, and wherein the actuating wall has a substantially convex profile in its undeformed position and a substantially concave profile in its deformed position, the deformed position occurring when the pressure exerted on the actuating wall reaches the threshold pressure $P_s$.

8. The device of claim 1, wherein the actuating wall of the reservoir is formed of thermoplastic material.

9. The device of claim 8, wherein the thermoplastic material is selected from polyethylenes, polypropylenes, polyethylene terephthalates, polyethylene naphthalates, polyacrylonitriles, polyoxymethylenes, and polyvinyl chlorides.

10. The device of claim 1, further comprising a diffuser comprising a nozzle and the spray orifice, the nozzle comprising at least one swirl-inducing duct.

11. The device of claim 1, wherein a portion of the device defining the spray orifice is configured to induce a swirl to product sprayed from the spray orifice.

12. The device of claim 10, wherein the diffuser is mounted on the reservoir via one of snap-fastening and screw-fastening.

13. The device of claim 1, wherein the reservoir defines an interior volume in an undeformed state ranging from about 0.2 milliliter to about 15 milliliters.

14. The device of claim 13, wherein the reservoir defines an interior volume in a deformed state ranging from about 0.17 milliliter to about 14 milliliters.

15. The device of claim 1, wherein the difference between an interior volume of the reservoir in an undeformed state and a deformed state ranges from about 0.01 milliliter to about 2.25 milliliters.

16. The device of claim 1, wherein the difference between an interior volume of the reservoir in an undeformed state and a deformed state ranges from about 5% to about 15% of the interior volume of the reservoir in the undeformed state.

17. The device of claim 1, wherein the device is configured to provide an atomizing spray of the product from the spray orifice.

18. The device of claim 1, wherein a portion of the reservoir opposite the actuating wall defines a substantially planar surface.

19. The device of claim 1, wherein the device defines a substantially tear-drop shape.

20. The device of claim 1, wherein at least a portion of the reservoir is one of at least partially transparent and at least partially translucent.

21. The device of claim 1, wherein the reservoir comprises at least one substance imparting a color to the reservoir.

22. The device of claim 1, wherein the reservoir comprises a first portion comprising the actuating wall and at least one other portion, and wherein when the threshold pressure $P_s$ is exerted on the first portion and the other portion, substantially only the actuating wall deflects.

23. The device of claim 1, further comprising a fluid product contained in the reservoir.

24. The device of claim 23, wherein, at least prior to a first use of the device, the product has a volume ranging from about 0.5 milliliter to about 15 milliliters.

25. The device of claim 23, wherein the product comprises at least one of a cosmetic product and a care product.

26. The device of claim 23, wherein the product comprises at least one component imparting a scent to the product.

27. The device of claim 26, wherein the product comprises at least one of a perfume and a cologne.

28. The device of claim 1, wherein the device is configured so that exerting of at least the threshold pressure $P_s$ on the actuating wall causes the actuating wall to deform suddenly, thereby creating an overpressure condition within the reservoir.

29. A method of dispensing a product, the method comprising:

providing the device for dispensing of claim 23; and exerting the threshold pressure $P_s$ on the actuating wall so as to spray the product from the spray orifice.

30. The method of claim 29, wherein the product comprises at least one of a cosmetic product and a care product.

31. The method of claim 30, further comprising directing spray of the product toward a body region.

32. The method of claim 29, wherein the product comprises at least one component imparting a scent to the product.

33. The method of claim 29, wherein the product comprises at least one of a perfume and a cologne.

34. The method of claim 29, wherein the spraying of the product occurs for a predetermined duration of time.

35. The method of claim 29, wherein the spraying occurs until the pressure exerted on the actuating wall drops below the threshold pressure $P_s$.

36. The method of claim 29, wherein the exerting the threshold pressure $P_s$ results in the reservoir changing from an undeformed state to a deformed state, wherein the difference between an interior volume of the reservoir in the undeformed state and the deformed state ranges from about 0.01 milliliter to about 2.25 milliliters.

37. The method of claim 29, wherein the exerting the threshold pressure $P_s$ results in the reservoir changing from an undeformed state to a deformed state, wherein the difference between an interior volume of the reservoir in the undeformed state and the deformed state ranges from about 5% to about 15% of the interior volume of the reservoir in the undeformed state.

38. The method of claim 29, wherein the volume of the product sprayed ranges from about 0.01 milliliter to about 2.25 milliliters.

* * * * *